United States Patent [19]

Miyamori et al.

[11] 4,314,981

[45] Feb. 9, 1982

[54] METHOD FOR PREPARING CARBON FIBERS

[75] Inventors: Tamotsu Miyamori; Hisatsugu Kaji; Iwao Kameyama; Michio Takahashi, all of Iwaki, Japan

[73] Assignee: Jureha Kagaku Kogyo Kabushiki Kaisha, Tokyo, Japan

[21] Appl. No.: 105,130

[22] Filed: Dec. 19, 1979

[30] Foreign Application Priority Data

Dec. 26, 1978 [JP] Japan ..... 53-163715

[51] Int. Cl.[3] ..... C01B 31/07

[52] U.S. Cl. ..... 423/447.7; 264/29.2; 264/29.6; 264/29.7; 423/447.8

[58] Field of Search ..... 264/29.2, 29.6, 29.7; 423/447.4–447.8

[56] References Cited

U.S. PATENT DOCUMENTS

| | | | |
|---|---|---|---|
| 3,011,981 | 12/1961 | Soltes | 423/447.8 |
| 3,716,607 | 2/1973 | Otani | 264/29.6 |
| 3,767,741 | 10/1973 | Toyoguchi et al. | 264/DIG. 19 |
| 3,935,301 | 1/1976 | Morita et al. | 423/447.4 |
| 4,032,607 | 6/1977 | Schulz | 423/447.4 |
| 4,100,004 | 7/1978 | Moss et al. | 264/29.2 |

FOREIGN PATENT DOCUMENTS

| | | | |
|---|---|---|---|
| 50-42126 | 4/1975 | Japan . | |
| 50-69320 | 6/1975 | Japan . | |
| 51-43428 | 4/1976 | Japan . | |
| 52-74026 | 6/1977 | Japan . | |
| 863219 | 3/1961 | United Kingdom . | |
| 1405891 | 9/1975 | United Kingdom | 264/29.2 |
| 1416614 | 12/1975 | United Kingdom . | |

*Primary Examiner*—Jay H. Woo

*Attorney, Agent, or Firm*—Wegner & Bretschneider

[57] ABSTRACT

The present invention relates to a method for preparing carbon fibers from a pitch by treating the pitch fibers spun from a pitch with a gaseous mixture of air and a gaseous oxidizing agent in an infusibilizing furnace divided into at least two chambers arranged in series and then carbonizing the thus treated pitch fibers into carbon fibers.

17 Claims, 1 Drawing Figure

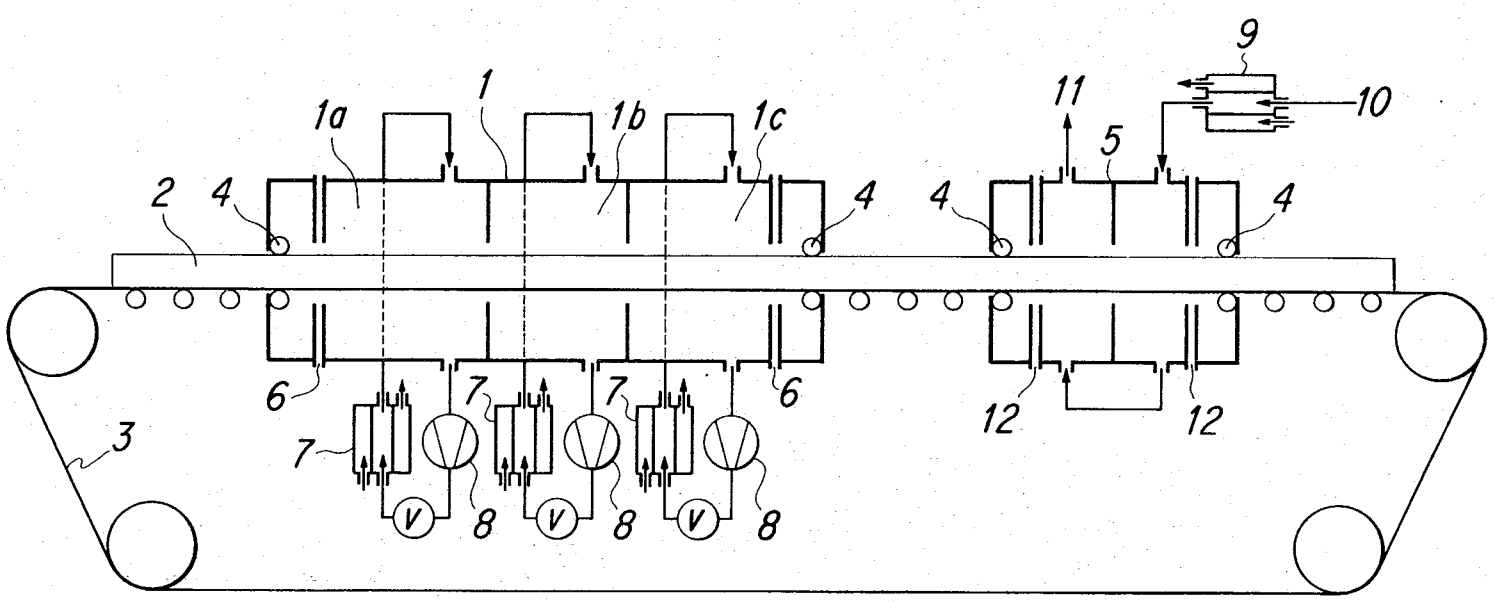
1
1a
1b
1c
2
3
4
5
6
7
8
9
10
11
12
V

METHOD FOR PREPARING CARBON FIBERS

BACKGROUND AND SUMMARY OF THE INVENTION

The present invention relates to a method for preparing carbon fibers by treating pitch fibers spun from a pitch with a gaseous mixture of air and a gaseous oxidizing agent to be infusibilized, and carbonizing the thus treated pitch fibers into the carbon fibers.

In the preparation of the carbon fibers, the pitch fibers are subjected to a treatment of infusibilization of the pitch fibers before the carbonization thereof. The pitch fibers are made infusible when the pitch fibers are subjected to a take-up system in which the pitch fibers are fed and taken-up around a roll, or a net-belt conveyer system in which the pitch fibers are loaded on and transferred by a net-belt conveyer. However, in the take-up system, a high productivity cannot be obtained since the pitch fibers cannot be taken up at a high velocity due to the low physical strength and ductility thereof. Moreover, it takes much time to mend pitch fibers when it is broken during the reaction according to this system.

In the well-known net-belt conveyer system, the pitch fibers are formed into waves by the net-belt and the fibers are locally deformed by the meshes of the net, because the pitch fibers are not sufficiently infusibilized in the steps in the infusibilizing furnace.

The inventor had found that these problems are solved by providing a bar on the upper part of a tray having a u-type cross section and introducing the tray having the pitch fibers suspended on the bar into the furnace of infusibilization and of carbonization thereby effectively carrying out the infusibilization and carbonization (refer to Japanese Patent Application No. 53-78555/78).

However, in the tray system, the height of suspension of the fiber is restricted by the strength of the fiber, and the packing density of the fiber cannot be made so much larger because of the necessity of preventing the accumulation of heat generated by the infusibilizing reaction and the necessity of uniforming the gas flow for the sufficient replacement of the generated gas in the carbonization than the ordinary value of 1 to 20 kg/m$^3$. Such an amount of the packing density of the fiber is too small from the economical view. That is, in order to make the capacity of the total facilities, it was necessary to have larger furnaces of infusibilization and of carbonization. This was not desirable from the consideration of raising the production efficiency.

Therefore, it is an object of the present invention to provide an efficient method for preparing carbon fibers from a pitch. This and other objects have been attained by the method of the present invention comprising:

loading the above-mentioned pitch fibers on a net-belt conveyer;

introducing the thus loaded fibers into an infusibilizing furnace having at least two exposing chambers arranged in series, each of the exposing chambers having an atmosphere maintained at a different maximum temperature, thereby raising the temperature of the infusibilizing furnace of a longitudinal direction from the inlet to the outlet of the furnace by steps;

exposing the introduced fibers to a gaseous mixture of air and a gaseous oxidizing agent by passing the gaseous mixture through the introduced fibers at a temperature lower than the softening point of the pitch fibers by 5° to 50° C. on the way of infusibilizing to expose in each of the above-mentioned chambers, thereby infusibilizing the fibers;

introducing the exposed pitch fibers into the carbonizing furnace; and carbonizing the introduced pitch fibers therein by a flow of an inert gas heated to a temperature of 400° to 1,500° C.

BRIEF EXPLANATION OF THE DRAWINGS

The attached figure of the drawing is an apparatus suitable for executing the method of the present invention.

DETAILED DESCRIPTION OF THE INVENTION

According to the present invention, the pitch fibers obtained by the melt-spinning of the pitch prepared from a petroleum-tar or coal-tar are loaded on a net-belt conveyer at a high packing density and introduced into an infusibilizing furnace, for instance, as is shown in the attached figure by the movement of the net-belt conveyer to be infusibilized in the furnace, and the thus infusibilized fibers are then introduced into the carbonizing furnace also by the movement of the net-belt conveyer to be carbonized in the carbonizing furnace. Since the diameter of the pitch fiber is as small as less than 40 micron, it is preferable to combine tens of thousands of fibers to a tow of 10 to 30 mm in diameter in advance of the above-mentioned treatments of infusibilization and of carbonizing in order to raise the production efficiency.

In the above-mentioned treatment of infusibilization and of carbonization, the packing density of the pitch fibers on the net-belt conveyer is variable to an optional extent freely by piling up the tows with a pressure. However, an excessive packing density causes an insufficient removal of the heat generated in the process of infusibilization resulting in the temperature raise within the tow, which possibly makes the pitch fibers over-oxidized. On the other hand, too small a packing density makes the production efficiency unfavorable. Accordingly the usual packing density of the pitch fibers in actual use are 30 to 300 kg/m$^3$, preferably 50 to 200 kg/m$^3$. In the next place, the packing height of the pitch fibers may be changed suitably, however, generally it is 20 to 500 mm. Too large the height makes the packing density of the lower layer of the pitch fibers too large by dead load causing the insufficient removal of the generated heat. On the other hand, too small the height the production efficiency becomes unfavorable.

The net-belt conveyer used in the present invention is made of a metallic material, for instance, titanium and stainless steel, and has a net-like construction or has numerous pores in order to pass a gas freely through the net.

In order to adjust the internal temperature of the tow in the case of introducing the net-belt conveyer loaded with the pitch fibers, since the pitch fibers are loaded with a large packing density, a natural convection generated in an infusibilizing furnace hitherto utilized and an accompanying gas flow generated by a jet nozzle are insufficient. Since the gaseous mixture does not pass through the internal part of the tow, the removal of the heat of infusibilization is not favorably carried out and so an uneven temperature distribution occurs within the tow not only to be the cause of an unevenness of the fibers after carbonization but also to burn the fibers. For that reason, it is necessary to remove the heat of infusibilization by forced ventilation.

That is, in the method of the present invention, a blower or a fan is provided in each chamber of the furnace, divided with an appropriate interval to once pull out the gaseous mixture from the lower part of the chamber and then supply the gaseous mixture to the upper part of the chamber, or inversely to pull out the gas from the upper part and then supply to the lower part, in any event, in order to make the gaseous mixture flow up and down. In any way, there are more than 2 means of gas circulation as shown above. In this means of gas circulation of the present invention, heat exchangers are incorporated in order to remove the heat of infusibilization to maintain constant conditions of the gas.

By the above-mentioned up-and-down wise ventilation, the tows comprising the pitch fibers, placed on the net-belt conveyer, are brought into contact with or exposed to a gaseous mixture containing a gaseous oxidizing agent such as $NO_2$ coming vertically from the mesh of the net-belt, therefore, the reaction heat generated not only from the surface of the tow but also that from each pitch fiber are effectively removed. Accordingly, in the method of the present invention, the removal of the heat of infusibilization is carried out efficiently in spite of the high packing density of the pitch fibers. That is, an infusibilization at a very high packing density of the pitch fibers has come to be possible, such a high packing density having never been considered in the conventional tray system of infusibilization in which the heat removal is carried out by the diffusion of the gaseous mixture containing $NO_2$ from the surface of the tow to its internal parts, the gaseous mixture being brought into parallel contact to the suspended tows.

In addition, because of the efficient contact of the inert gas at a high temperature into the infusibilized tows, the time period of carbonization has been possibly reduced to highly improve the production efficiency.

Because of the adoption of the net-belt conveyer in the present invention, there are large advantages of having a smaller aperture and of needlessness of providing two additional chambers for gas replacement in the neighbourhood of the inlet and outlet of the infusibilizing furnace and the carbonization furnace. Although there are several methods for isolating the furnace from the outside, for instance, a method of providing nipping-rollers at the inlet and outlet of the furnace or a method of making a gas-seal at the inlet and outlet parts is adopted. By these methods it is possible to prevent the change of the composition and the temperature of the gas in the atmosphere of the furnace. In the infusibilizing furnace, the construction is so designed that the temperature of the gas in the atmosphere is gradually raised from the inlet toward the outlet. Into the carbonizing furnace, an inert gas such as nitrogen is introduced at a high temperature and the infusibilized tow-shaped bundles of the pitch fibers loaded on the net-belt conveyer from the infusibilizing furnace introduced into the carbonizing furnace are continuously brought into contact with the inert gas at a perpendicular at the high temperature of 400° to 1,500° C. for a residence time of 0.1 to 1.5 hours to be carbonized. The rate of the inert gas used in the furnace is 0.5 to 5 $Nm^3$ per kg of the infusibilized pitch fibers.

In the practice of the present invention, the pitch fibers 2 are loaded mat-like on the net-belt conveyer 3 and they are introduced into three chambers, 1*a*, 1*b* and 1*c*, in the order, provided in the infusibilizing furnace 3 via the nipping-roller 4. The nipping-roller acts to isolate the furnace from the outside.

Additionally, at the inlet part of the infusibilizing furnace, gas-inducing inlet 6 for use in an air curtain is provided, from which a small amount of air is introduced to make isolation from the atmosphere of outside for preventing the change of the gaseous composition of the atmospheric gas and the reduction of the temperature within the infusibilizing furnace.

Moreover, the temperature raise in the furnace occurring accompanying with the proceeding of infusibilization due to the heat of infusibilization of the pitch fibers is possibly controlled by making a flow of the atmospheric gas in the furnace by the blower or a fan 8 and by the heat exchanger 7. The heat-removing effect is improved by increasing the circular gas flow rate such that the temperature difference between the softening point of the pitch fiber and the gas of the atmosphere in the furnace is reduced and the infusibilization of the pitch fibers is finished within a short period of time while avoiding the mutual adhesion of the pitch fibers. The direction of the circulating gas may be upward or downward, however, since in the case of the upward flowing the pitch fibers loaded on the net-belt conveyer are apt to be brought upwards with the gas flow and get twisted necessitating another belt for pressing down the mat-like blowing up, it is preferable to have a downward flow.

In the case where the velocity of the circulating gas is too large, the pitch fibers are pressed by the gas flow, resulting in the increase of packing density of the fiber in excess. However, generally, the velocity of circulating gas (Nm/sec) is raised in proportion to the packing density ($kg/m^3$) of the pitch fibers. In the case where the velocity of the circulating gas in the pitch fibers is smaller as compared to the packing density, as a result of uneven distribution of the gas for heat removal, an uneven temperature distribution occurs in the pitch fibers, which causes not only the unevenness of the physical properties of the carbonized fiber but also some reaction in the fibers. The preferable velocity of the circulating gas is 0.1 to 1.5 Nm/sec in operation.

The temperature of infusibilization is preferably in the neighbourhood of the softening temperature of the pitch fiber as possible because the time period for infusibilization is shorter, however, in the case of raising the temperature too high to the vicinity of the softening point, partially the temperature of the fiber becomes higher than the pitch possibly making the fiber adhered each other. In opposition, in the case where the difference between the temperature of infusibilization and the softening point is too large, it takes much time for the reaction to be completed necessitating a larger furnace for infusibilization, that is, the temperature of infusibilization is preferably lower than the softening point of the pitch fiber by 5° to 50° C. For instance, in the case of infusibilizing of the pitch fibers of a softening point of about 165° spun from the polymerized pitch produced by treating petroleum pitch, the temperature of the pitch fibers at the inlet part of the infusibilizing furnace is set to 160° to 115° C. Although the softening point of the pitch fiber shifts toward higher side as the infusibilization proceeds, the temperature of the pitch fiber is artificially raised slowly in order to maintain the temperature difference between the softening point and the temperature of the pitch fiber at constant until the softening point becomes about 300° C.

It is necessary to provide at least two sets of gas circulating means in the furnace, however, preferably by providing more than 3 sets of gas-circulating means a suitable temperature distribution is obtainable corresponding to the change of physical properties of the pitch fiber as the infusibilization proceeds.

However, it is preferable to adjust the conditions to bring the temperature of the pitch fiber not higher than 350° C., more preferably not higher than 300° C. At a too much higher temperature, the infusibilization proceeds too far resulting in the deterioration of the finally obtained carbon fiber, particularly its tenacity is reduced and its elongation becomes worse.

The transferring velocity of the net-belt conveyer relates to the size of the infusibilization furnace, and is optionally variable, and usually it is designed to have the residence time of 1 to 4 hours in the furnace. The usually used velocity is 0.5 to 50 m/hr.

The pitch fibers on the net-belt conveyer, after finishing infusibilization, carried out from the outlet of the furnace via the nipping-roller 4, the outlet of the furnace being isolated from the atmosphere outside of the furnace by air sealing as in the inlet of the furnace.

The pitch fibers on the net-belt conveyer carried out from the above-mentioned infusibilizing furnace are introduced into the internal part of the carbonizing furnace via the nipping-roller 4 as in the infusibilizing furnace. Nitrogen-seals with an inlet 12 of nitrogen are provided respectively in the inlet and outlet of the carbonizing furnace, and a small amount of an inert gas, for instance, gaseous nitrogen is introduced to isolate the furnace from the atmosphere outside the furnace.

An inert gas, for instance, gaseous nitrogen heated to a temperature of higher than 400° C. by a heat exchanger 9 is introduced into the carbonizing furnace from the inlet 10. After being brought into contact at a right angle with the surface of the mat of the infusibilized pitch fibers, the gas passes through the part of the furnace under the belt conveyer and then goes out from the outlet 11 containing an evaporative component, for instance water and then, if necessary, its heat being recovered. By the above-mentioned procedures, the infusibilized pitch fibers which entered into the carbonizing furnace are heated and carbonized at a temperature of 400° to 1,500° C., preferably at a temperature of 500° to 1,000° C. If necessary, heat may be supplied from outside of the furnace.

The infusibilized pitch fibers on the belt conveyer are directly heated by the inert gas at a high temperature from underside or from upper side and effectively carbonized and after usually 0.1 to 1.5 hours of carbonization carried out from the outlet of the furnace via the nipping-roller.

The higher the temperature of carbonization, the shorter the time for carbonization, however, too much high a temperature is not preferable, because it restricts the material of construction of the conveyer belt, and a large amount of volatile materials generates at a time by the rapid heating of the fiber resulting in the porous fiber with a reduced tenacity and elongation.

The net-belt conveyer may be used in common with the infusibilizing furnace and the carbonizing furnace or each independent net-belt conveyer may be used in each furnace. In the case of using separated conveyer belts, a step of tranship is necessary, however, velocities of two conveyers may be different and there is an advantage of using conveyer belts different in their materials.

By carrying out infusibilization of the pitch fibers utilizing a net-belt conveyer and using the infusibilizing furnace divided into at least two chambers and further by carrying out the carbonization of the thus infusibilized pitch fibers as in the present invention, the infusibilization and the carbonization of a highly packed pitch fibers become possible with an improved production efficiency, as has been described in the present invention.

Moreover, coupled with the needlessness of the additional chambers for replacement in entrance and exit, the remarkable scale down of the infusibilizing furnace and the carbonizing furnace has come to be possible accompanied by reducing the heat loss in the carbonizing furnace and the consumption of the inert gas. Furthermore, the quality of the thus obtained carbon fiber represented by its tenacity and elongation is not different from the carbon fiber produced by the tray system.

The followings are the more concrete explanation of the present invention referring to the non-limiting example.

EXAMPLE

After melt-spinning pitch fibers from a pitch having a softening point of 165° C. obtained by heat-treating an ethylene bottom oil, the pitch fibers were loaded on a net-belt conveyer having a stainless steel wire net of 5 mesh and a width of 0.5 m and introduced into the infusibilizing furnace of about 6 m in length shown in the attached figure at the transferring velocity of the belt conveyer of 3 m/hour and the pitch fibers were infusibilized therein at a packing density of 100 kg/m$^3$ with a packed layer of 200 mm in height under the following conditions of:

(1) a gaseous mixture of air and $NO_2$, containing $NO_2$ 1.0% by volume, (2)
the maximum temperature of chamber 1*a:* 150° C.
the maximum temperature of chamber 1*b:* 200° C.
the maximum temperature of chamber 1*c:* 250° C., (3) the temperature difference between the softening point and the temperature of the pitch fiber in treatment: 15° to 30° C., (4) the time period of infusibilization: 1.8 hours, (5) the velocity of the circulating gas in each chamber: average 0.5 Nm/sec.

In the next step, the thus infusibilized pitch fibers were introduced into the carbonizing furnace of about 2 m in length at the same transferring velocity as in the infusibilizing furnace. By using gaseous nitrogen as an inert gas heated to a temperature of 1,000° C. by an external heat exchanger at a volume of 2 Nm$^3$/kg of the product, carbon fiber, the internal temperature of the furnace could be heated to a predetermined temperature of carbonization of 800° C., and carbon fibers of good quality were obtained after carbonization for 40 minutes. The properties of the thus obtained carbonized fiber are shown in the Table, they being not inferior to those of the carbon fiber prepared by the conventional tray system wherein the consumption of gaseous nitrogen was 7 to 8 Nm$^3$/kg of the product.

TABLE

Properties of Carbon Fiber Prepared by Several Methods

| Carbon fiber (method) | Packing density ($kg/m^3$) | Aspect of infusibilization | Diameter (micron) | Tenacity (g) | Tensile strength ($kg/m^2$) | Elongation (%) |
|---|---|---|---|---|---|---|
| The present invention | 100 | good | 13–16 | 12.6 | 75.3 | 2.90 |
| Conventional net-belt system | 100 | no good | 10–20 | 4 | <30 | <1 |
| Tray system | 4–10 | good | 13–16 | 12.5 | 76.2 | 2.91 |

What is claimed is:

1. A method of preparing carbon fibers from a pitch, wherein the pitch is spun into pitch fibers, the pitch fibers are treated with an oxidizing gas and the treated fibers are carbonized into the carbon fibers, said method comprising:

loading said pitch fibers on a net-belt conveyor at a packing density of 30 to 300 $kg/m^3$ at a packing height of up to 500 mm.

introducing the loaded pitch fibers on said net-belt conveyor into a infusibilizing furnace having at least two exposing chambers arranged in series of increasing temperature said exposing chambers having a temperature gradient of 5° to 100° C. per chamber in the direction of from the inlet to the outlet of said infusibilizing furnace;

exposing the introduced pitch fibers to a gaseous mixture of air and a gaseous oxidizing agent by passing said gaseous mixture between said introduced fibers at a temperature lower than the softening point of said pitch fibers by 5° to 50° C., the velocity of said passing gaseous mixture being increased in proportion to the packing density of the pitch fibers within the velocity range of 0.1 to 1.5 Nm/sec, thereby infusibilizing said pitch fibers, introducing the thus infusibilized pitch fibers into a carbonizing furnace on the same or different net-belt conveyor, and carbonizing the introduced infusibilized pitch fibers by a flow of an inert gas heated to a temperature of 400° to 1,500° C.

2. The method according to claim 1, wherein said pitch fibers are prepared from a petroleum-tar pitch or coal-tar pitch.

3. The method according to claim 2, wherein said petroleum-tar or coal-tar pitch has a softening point of 50° to 300° C.

4. The method according to claim 1 wherein said temperature gradient is 10° to 50° C.

5. The method according to claim 1, wherein said temperature in said infusibilizing furnace has a maximum temperature of 200° to 400° C.

6. The method according to claim 5, wherein said maximum temperature is 200° to 280° C.

7. The method according to claim 1, wherein the temperature of said gaseous mixture is controlled to be lower than the softening point of said pitch fibers on the way of infusibilizing by 10° to 20° C.

8. The method according to claim 1, wherein said gaseous oxidizing agent is selected from the group consisting of oxygen, ozone, sulfur trioxide and $NO_2$.

9. The method according to claim 1 or 8, wherein said oxidizing agent is $NO_2$.

10. The method according to claim 1, wherein said gaseous mixture comprises 90 to 99.9% by volume of an air and 0.1 to 10% by volume of $NO_2$.

11. The method according to claim 1, wherein said gaseous mixture is blown perpendicularly onto the loading surface of said net-belt conveyor.

12. The method according to claim 11, wherein said gaseous mixture is blown downward in a perpendicular direction to said loading surface.

13. The method according to claim 1, wherein said pitch fibers are exposed to said gaseous mixture for 1 to 4 hours.

14. The method according to claim 1, wherein said exposed and infusibilized fibers are carbonized at a temperature of 400° to 1,500° C. for 0.1 to 1.5 hours.

15. The method according to claim 1, wherein said inert gas is gaseous nitrogen.

16. The method according to claim 1, wherein said pitch fibers are formed into a tow-like shape.

17. The method according to claim 1, wherein said gaseous mixture further acts to remove surplus heat generated by the infusibilizing reaction.

* * * * *

UNITED STATES PATENT AND TRADEMARK OFFICE

CERTIFICATE OF CORRECTION

PATENT NO. : 4,314,981

DATED : February 9, 1982

INVENTOR(S) : Tamotsu MIYAMORI ET AL

It is certified that error appears in the above—identified patent and that said Letters Patent is hereby corrected as shown below:

On the Title page Item [73] Assignee:

please change "Jureha" to --Kureha--

Signed and Sealed this

First Day of June 1982

[SEAL]

Attest:

GERALD J. MOSSINGHOFF

Attesting Officer

Commissioner of Patents and Trademarks